US005345922A

United States Patent [19]

Ott

[11] Patent Number: 5,345,922

[45] Date of Patent: Sep. 13, 1994

[54] CATAPULT DEVICE

[76] Inventor: Peter P. Ott, 237 Canyon Acres Dr., Laguna Beach, Calif. 92651

[21] Appl. No.: 177,233

[22] Filed: Jan. 4, 1994

[51] Int. Cl.[5] ..... F41B 7/00

[52] U.S. Cl. ..... 124/20.1; 124/16

[58] Field of Search ..... 124/20.1, 16, 17, 20.3, 124/25, 35.1, 1

[56] References Cited

U.S. PATENT DOCUMENTS

| | | | |
|---|---|---|---|
| 1,892,405 | 12/1932 | Metzger | 124/17 |
| 3,494,346 | 2/1970 | Yount et al. | 124/20.1 |
| 3,918,427 | 11/1975 | Turner | 124/20.3 |
| 3,974,820 | 8/1976 | Ott . | |
| 4,050,438 | 9/1977 | Pfotenhauer | 124/20.1 |
| 4,169,453 | 10/1979 | Hunsicker . | |
| 4,411,248 | 10/1983 | Kivenson . | |
| 4,458,658 | 7/1984 | Blair | 124/20.1 |
| 4,703,744 | 11/1987 | Taylor et al. . | |
| 4,877,007 | 10/1989 | Olson | 124/20.3 |
| 4,911,136 | 3/1990 | Brown | 124/20.1 |
| 5,125,388 | 6/1992 | Nicely et al. . | |

FOREIGN PATENT DOCUMENTS

| | | | |
|---|---|---|---|
| 396374 | 5/1924 | Fed. Rep. of Germany | 124/20.1 |

*Primary Examiner*—Randolph A. Reese
*Assistant Examiner*—Anthony Knight
*Attorney, Agent, or Firm*—Poms, Smith, Lande & Rose

[57] ABSTRACT

A catapult device having a main body portion, a downwardly extending pistol grip, and a pair of forwardly extending spaced arms. A pair of elastomeric members are each attached at one end to a projectile holder and at the other end to one of a plurality of spaced open slots on opposite sides of the main body portion. The elastomeric members pass about spaced rotatable pulleys mounted in each free end of the spaced arms.

10 Claims, 1 Drawing Sheet

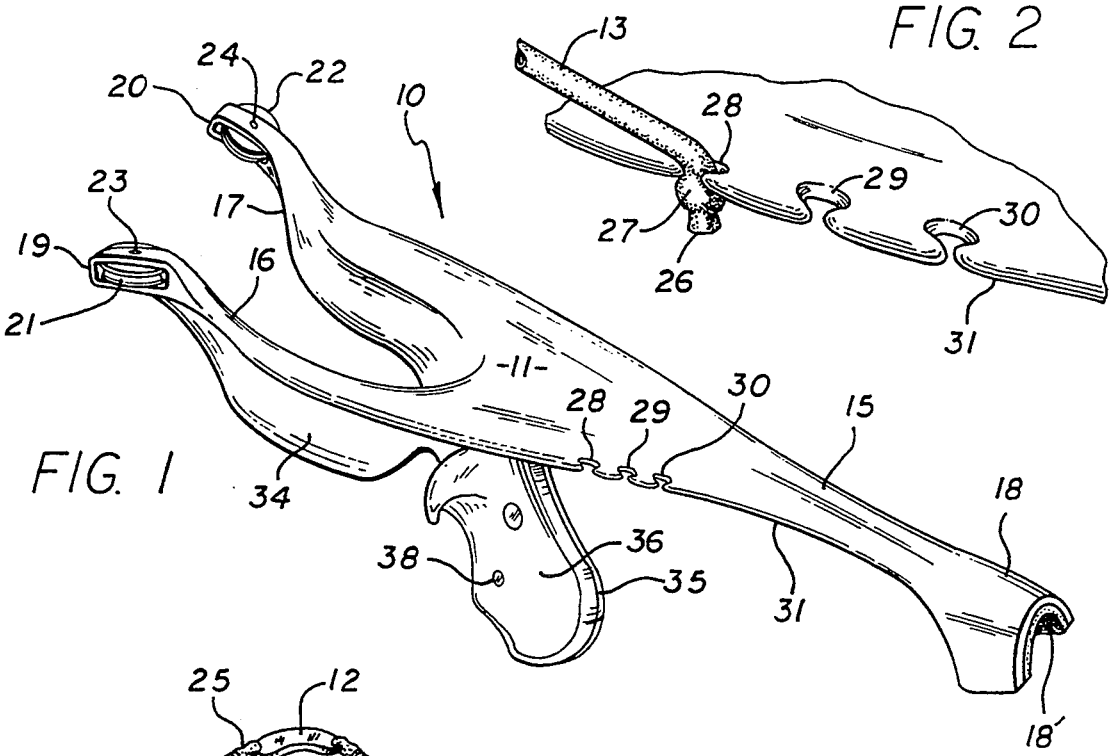
FIG. 1
FIG. 2
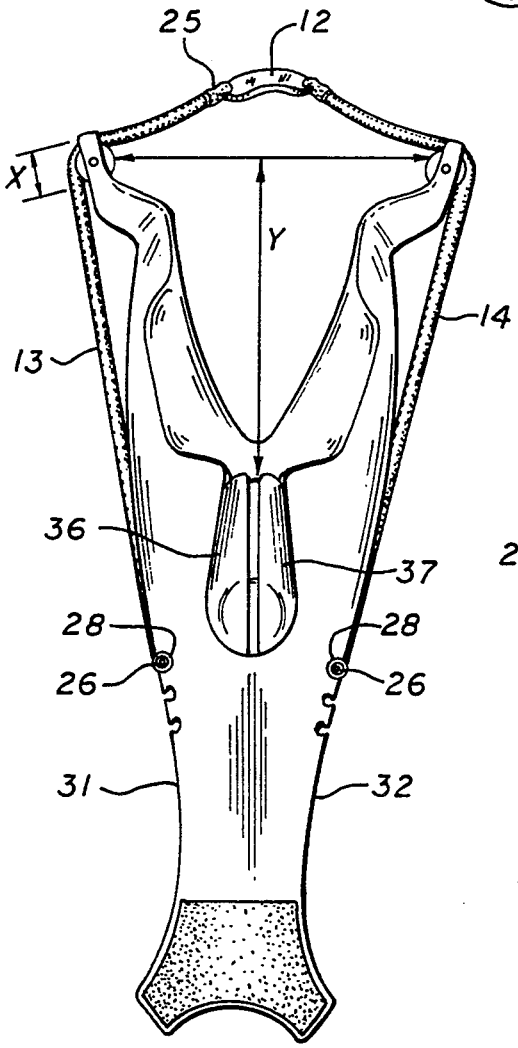
FIG. 3
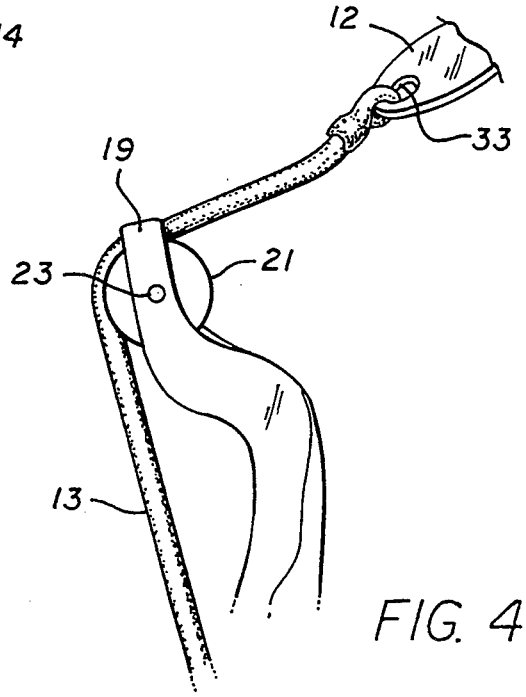
FIG. 4

CATAPULT DEVICE

BACKGROUND OF THE INVENTION

1. Field of the Invention

The invention relates to catapult devices; and, more particularly, to a catapult device having improved drawing power and more forceful projectile delivery.

2. Description of the Prior Art

Catapult devices for shooting projectiles for use in hunting or the like are well known in the prior art. In my U.S. Pat. No. 3,974,820, I disclosed a portable catapult device that includes a wishbone shaped frame defined by an elongate shank and two laterally spaced forwardly disposed arms. The whole device is composed of a molded one piece design. The arms support two transversely slotted heads. The slotted heads are removably engaged by two elongate elastic members in such a manner, that when the members are tensioned by being drawn rearwardly and then released, a pouch connected to the rearward ends of the members in which a projectile is disposed in a self-centering position is propelled forwardly to remain in contact with the projectile until the pouch moves forwardly beyond the arms to a position that is substantially the length of the members. Due to the pouch remaining in contact with the projectile for the maximum length of travel, the projectile is discharged from the pouch with the maximum velocity possible with the particular resilient members that are used. The shank functions as a shield for the forearm of a user.

There is a need for a catapult device such as the one in my patent that has more drawing power and delivers a projectile with greater speed.

SUMMARY OF THE INVENTION

It is an object of this invention to provide an improved catapult device.

It is a further object of this invention to provide a catapult device that has more drawing power than prior art devices and can deliver a projectile with greater speed.

It is still further an object of this invention to provide a catapult device wherein the drawing power may be varied.

These and other objects are preferably accomplished by providing a catapult device having a main body portion, a downwardly extending pistol grip, and a pair of forwardly extending spaced arms. A pair of elastomeric members are each attached to one end to a projectile holder and at the other end to one of a plurality of spaced opposite open slots on opposite sides of the main body portion. The elastomeric members pass about spaced rotatable pulleys mounted in each free end of the spaced arms.

BRIEF DESCRIPTION OF THE DRAWING

FIG. 1 is a perspective view of a catapult device in accordance with the teachings of the invention;

FIG. 2 is a detailed view of a portion of the device of FIG. 1;

FIG. 3 is a bottom plan view of the device of FIG. 1; and

FIG. 4 is a detailed view of another portion of the device of FIG. 1.

DESCRIPTION OF THE PREFERRED EMBODIMENT

Referring now to FIG. 1 of the drawing, a catapult device 10 is shown having a rigid housing 11. As seen in FIG. 3, a strip 12, in which a projectile (not shown) may be held, is shown coupled to two elongated elastomeric members 13, 14. FIG. 1 of my U.S. Pat. No. 3,974,820, the teachings of which are incorporated by reference, shows a catapult device similar to the device 10 herein held by a user and projecting a projectile D. Although a strip 12 of flat planar material, such as leather, may be used in which a pellet-like projectile is held, obviously a pouch may be used as shown in FIGS. 4 and 6 of U.S. Pat. No. 3,974,820 and fully described therein.

Thus, strip 12 is shown connected to free ends of members 13, 14.

Housing 11 has an elongated shank portion 15, arcuate in cross section, with a pair of laterally spaced arms 16, 17 projecting forwardly therefrom. The terminal end 18 of housing 11 is also arcuate and open as shown for placement about the arm of a user as shown in FIG. 1 of U.S. Pat. No. 3,974,820. The interior of housing 11, where it straddles one's arm, may be padded as at padding 18' (FIG. 1).

Each arm 16, 17 terminates at the forward end in spaced heads 19, 20, respectively. These heads are in the form of open slots forming pulling blocks for receiving therein pulleys, such as pulleys 21, 22, respectively. These pulleys 21, 22 are rotatably mounted in their respective pulling blocks by pins 23, 24, respectively. Pins 23, 24 thus extend through ends 19, 20 and pulleys 21, 22, respectively, with pulleys 21, 22 freely rotating therein.

Members 13, 14 are preferably elongated pieces of hollow rubber surgical tubing, each member 13, 14 having a forward end 25 and a rearward end 26. As seen in dotted lines in FIG. 2, the ends 26 are expanded by spherical objects 27, such as of plastic inserted therein of such a diameter that the rear ends 26 are radially expanded to the extent that they cannot pass through a plurality, such as three, of spaced notches 28 to 30, e.g., about 1" apart, along each side edges 31, 32, respectively (see FIG. 3) of housing 11. The distance between notches 28 and 30 may be about 6" with notch 28 being about 4" from the forward end and notch 30 being about 6" from the head.

Thus, each member 13, 14 has its rear end 26 disposed in a spaced notch along side edges 31, 32, respectively. As seen in FIG. 3, these ends 26 are both disposed in forward notches 28.

Each member 13, 14, then extends about its respective pulley 21, 22, through its respective slot 19, 20, to strip 12. Each member 13, 14 is coupled to a hole 33 (FIG. 4) in strip 12 in any suitable manner, for example, in the manner shown in FIGS. 4 to 6 of U.S. Pat. No. 3,974,820 and described therein.

Arms 16, 17 having longitudinally and downwardly extending flanges 34 (FIG. 1), again as in U.S. Pat. No. 3,974,820, which merge into a pistol type handle 35. Handle 35 may have gripping portions 36, 37 (see also FIG. 3) on each side thereof that are held in place by screws 38 or any other suitable fastening means. Thus, handle 35, grips 36, 37 and screws 38 form a pistol grip for catapult device 10.

In operation, device 10 is grasped via pistol grip or handle 35 with arcuate portion 18 extending over the forearm of the user as shown in FIG. 1 of U.S. Pat. No.

3,974,820 and described therein. End 18 is thus in pressure contact with the user's forearm and the user can draw strip 12 rearwardly to tension members 13, 14.

The length x (FIG. 3) of each slotted end 19, 20 may be about $1\frac{1}{2}''$ thus providing a longer stretch to members 13, 14 over the device in U.S. Pat. No. 3,974,820 thereby increasing the projectile speed. The distance y (FIG. 3) is about 6". The three sets of spaced notches 28 through 30 allows for quick easy adjustment of the length of stretch to vary the projectile speed. Of course, more than three notches may be used. The 6" draw from the forward ends of slots 19, 20, to the user's hand is the same in this application as in my prior patent. However, in the invention disclosed in this application, the tubing 13, 14 wraps around pulleys 21, 22 and extends back to the notches 28 to 30 thereby increasing the draw of stretch from 4 to 6 additional inches, over the device in my patent, for a possible total of 12 inches.

The wrap around of the members 13, 14 over pulleys 21, 22 imparts a complete follow through as opposed to the pronged yolks in prior art devices directed toward the shooter. In those cases, the power band assemblies lose contact with the projectile well behind the shooter's fist. In applicant's claimed device, the strip 12 or the pouch of U.S. Pat. No. 3,974,820 remains in contact with the projectile through the yokes or arms 16, 17 and beyond thereby propelling the projectile toward the target for a longer distance than other similar devices utilizing elastic tubing. At the termination of follow through, the pouch or strip 12 is instantly inverted so as to release the projectile with utmost accuracy.

The housing 11, grip 36, and arms 16, 17 may be made of one piece of any suitable material, such as molded plastic, for example, carbon fiber material such as polycarbonate.

Thus, the device 10 is capable of quick and easy adjustment of tension using slots 28, 29, and 30. The use of the pulleys 21, 22 increases the overall power since one is pulling back further toward the handle or grip 36 increasing overall leverage. Although a strip 12 is disclosed, a pouch, such as pouch C in my U.S. Pat. No. 3,974,820, may be quickly and easily substituted for strip 12 using the techniques described in said patent. In like manner, a linear cord can be substituted merely by knotting the same to ends 25 to shoot darts or small arrows or the like.

Device 10 has a deep self centering pouch for mistake free shooting and spill-proof bird loads. Prong extensions or arms 16, 17 produces a 6" longer draw for increased projectile speed. The pulleys 21, 22 provide complete and recoilless follow-through, enhancing speed and accuracy. Arm brace 18 is padded and contoured for comfort and stability. This provides protection for one's wrist and hand. Members 13, 14 are quickly and easily interchangeable and can be switched in seconds and ready for use without need for any drying time. The sculptured wrap-around thumb and finger rests provided by handle 36 provides for optimum stability and accuracy. The tension adjustment systems disclosed herein provides from three to six inches additional power band stretch for increased projectile acceleration. Finally, this power band stretch is in addition to the 6" longer draw previously discussed.

In conclusion, the advantage of device 10 over the catapult device in my U.S. Pat. No. 3,974,820 are as follows:

1. The pulley system allows a friction free and recoilless follow through;
2. It has a power band tension adjustment system;
3. The new device provides the original 6" extended draw as on the previous patent but the above systems allow from 3 to 6" of additional power band stretch over the previous device, for a total of 12" extension; and
4. It has a $2\frac{1}{4}$ wider and 2" longer arm brace that doubles as a safety shield for the hand, wrist, and forearm.

Although a particular embodiment of the invention has been disclosed, variations thereof may occur to an artisan and the scope of the invention should only be limited by the scope of the appended claims:

I claim:

1. In a portable catapult device including a projectile holding member, two elongated laterally spaced elastomeric members secured to opposite ends of said holding member, a housing having spaced elongated sides and a pair of spaced arms extending outwardly from a main body portion, said free ends of said elastomeric members being attached to opposite sides of said holding member, said main body portion having an integral downwardly extending pistol-type handle, the improvement which comprises:

a pair of pulleys rotatably mounted on the extreme forwardly extending ends of said arms, said elastomeric members extending about respective ones of said arms; and a plurality of spaced slotted holes provided on each side of said main body portion, a first one of said spaced slotted holes on one side of said main body portion being aligned with a first one of said spaced slotted holes on the other side of said main body portion, and at least a second one of said spaced slotted holes on one side of said main body portion being aligned with a second one of said spaced slotted holes on the other side of said main body portion, one of said free ends of said elastomeric member being secured in one of said aligned slotted holes on one side of said main body portion and the other of said free ends of said elastomeric members being secured in one of said aligned slotted holes on the other side of said main body portion.

2. In the device of claim 1 wherein each of said arms terminate in a slot, said pulleys being pivotally mounted in respective ones of said slots, the axis of rotation of each pulley being perpendicular to the plane of said housing, each of said pulleys rotating in a plane generally normally to said axis.

3. In the device of claim 2 wherein the overall length of said slots is about $1\frac{1}{2}$ inches.

4. In the device of claim 1 wherein the depth of said slotted holes on said arms is about $\frac{3}{8}$ inches.

5. In the device of claim 1 wherein the rearward end of said main body portion curves arcuately and downwardly for conforming to the arm of a user.

6. In the device of claim 5 wherein the interior of said curved portion is cushioned.

7. In the device of claim 1 wherein said elastomeric members are hollow rubber tubings and one free end of one of said elastomeric members is attached to said housing by a ball inserted into the free open end thereof of a diameter greater than spacings in said housing through which said elastomeric members extend, and the free end of the other of said elastomeric members being attached to said housing by a ball inserted into the free open end of the last mentioned elastomeric member and also of a diameter greater than the spacings in said housing through which said elastomeric members extend, said balls being disposed on opposite sides of said housing.

8. In the device of claim 1 wherein each of said elastomeric members is a flexible hollow tube extending through a hole in said holding member and secured therein.

9. In the device of claim 1 wherein each of said elastomeric members is attached to said housing by extending through spaced slots on opposite sides of said main body portion, said spaced slots being open to the exterior of said main portion and of a diameter sufficient to receive said free ends of said elastomeric members therein.

10. In the device of claim 9 including retaining means mounted in the free ends of said elastomeric members for retaining the same in said slots.

* * * * *